US010998636B2

(12) United States Patent
Scheid et al.

(10) Patent No.: US 10,998,636 B2
(45) Date of Patent: May 4, 2021

(54) BROADBAND CAVITY-BACKED SLOT ANTENNA

(71) Applicant: Nokia Shanghai Bell Co., Ltd., Shanghai (CN)

(72) Inventors: Benedikt Scheid, Victoria (AU); Yan Cao, Victoria (AU); Ernest Fardin, Victoria (AU)

(73) Assignee: Nokia Shanghai Bell Co., Ltd, Shanghai (CN)

( * ) Notice: Subject to any disclaimer, the term of this patent is extended or adjusted under 35 U.S.C. 154(b) by 0 days.

(21) Appl. No.: 16/091,323

(22) PCT Filed: Apr. 5, 2017

(86) PCT No.: PCT/IB2017/051961
§ 371 (c)(1),
(2) Date: Oct. 4, 2018

(87) PCT Pub. No.: WO2017/175155
PCT Pub. Date: Oct. 12, 2017

(65) Prior Publication Data

US 2019/0157766 A1 May 23, 2019

Related U.S. Application Data

(60) Provisional application No. 62/318,661, filed on Apr. 5, 2016.

(51) Int. Cl.
*H01Q 13/18* (2006.01)
*H01Q 21/00* (2006.01)
*H01Q 21/08* (2006.01)

(52) U.S. Cl.
CPC ..... *H01Q 13/18* (2013.01); *H01Q 21/0075* (2013.01); *H01Q 21/08* (2013.01)

(58) Field of Classification Search
CPC ..... H01Q 13/18; H01Q 21/0006; H01Q 21/0075; H01Q 21/0081; H01Q 19/108; H01Q 1/246; H01Q 21/08
See application file for complete search history.

(56) References Cited

U.S. PATENT DOCUMENTS 3,545,001 A 12/1970 Giller ..... 343/776
3,750,185 A 7/1973 Evans ..... 343/814
(Continued)

FOREIGN PATENT DOCUMENTS

CN 102117968 A 7/2011
CN 102842757 A 12/2012
(Continued)

OTHER PUBLICATIONS

Targonski, S.D., et al., "Design of wide-band aperture-stacked patch Microstrip Antennas", IEEE Transactions on Antennas and Propagation 46(9), Oct. 1988, abstract, 1 pg.
(Continued)

*Primary Examiner* — Robert Karacsony
(74) *Attorney, Agent, or Firm* — Harrington & Smith

(57) ABSTRACT

An antenna includes a coupling device having first and second coupling plates, e.g. rectangular plates, connected at opposite ends of a conducting bar that acts as a stripline signal feed. A radio-frequency (RF) source may be connected to the conducting bar via a signal feed network. Multiple instances of the device may be arranged vertically in an antenna array assembly to operate together such that the radiation pattern of the antenna assembly is generally directed horizontally. The array may operate to provide a relatively flat azimuthal gain up to 180° across the UHF or VHF bands.

17 Claims, 7 Drawing Sheets

(56) References Cited

U.S. PATENT DOCUMENTS

| | | | | |
|---|---|---|---|---|
| 6,317,099 | B1 | 11/2001 | Zimmerman et al. | 343/803 |
| 2007/0080864 | A1 | 4/2007 | Channabasappa | 343/700 |
| 2012/0299790 | A1 | 11/2012 | Bounpraseuth | 343/795 |

FOREIGN PATENT DOCUMENTS

| | | | |
|---|---|---|---|
| CN | 202633514 | U | 12/2012 |
| CN | 103904423 | A | 7/2014 |
| CN | 104103906 | A | 10/2014 |
| CN | 104953257 | A | 9/2015 |
| EP | 1 267 448 | A2 | 12/2002 |
| WO | WO-2008/055526 | A1 | 5/2008 |

OTHER PUBLICATIONS

Anonymous; "Cavity-Backed Slot Antennas"; Antenna-theory.com; Dec. 15, 2020; Retrieved from the Internet: URL: http://vvww.antenna-theory.com/antennas/aperture/slot2.01D [retrieved on Dec. 15, 2020]; whole document (4 pages).

BROADBAND CAVITY-BACKED SLOT ANTENNA

CROSS-REFERENCE TO RELATED APPLICATIONS

This patent application is a U.S. National Stage application of International Patent Application Number PCT/IB2017/051961 filed Apr. 5, 2017, and claims priority to U.S. provisional patent application No. 62/318,661 filed Apr. 5, 2016, which are hereby incorporated by reference in their entireties.

TECHNICAL FIELD

The present disclosure relates generally to the field of radio-frequency communications, and, more particularly, but not exclusively, to methods and apparatus useful for VHF or UHF transmission on channels within a wide frequency range.

BACKGROUND

This section introduces aspects that may be helpful to facilitating a better understanding of the inventions. Accordingly, the statements of this section are to be read in this light and are not to be understood as admissions about what is in the prior art or what is not in the prior art. Any techniques or schemes described herein as existing or possible are presented as background for the present invention, but no admission is made thereby that these techniques and schemes were heretofore commercialized, or known to others besides the inventors.

Conventional cavity-backed slot antennas are typically regarded as narrow bandwidth antennas in the UHF TV frequency band. Often, only 20 or fewer channels (≤120 MHz) can be covered at any one time. Even then, individual slot tuning is usually necessary to reach acceptable return loss and radiation pattern performance. Such performance constraints are undesirable and typically increase costs of transmission installation and/or repurposing for other frequencies/channels.

FIGS. 1A and 1B illustrate two types of conventional cavity-backed slot antennas. In a cavity-backed slot antenna, the slot is typically fed using only a single coupling element in the center of the slot, sometimes referred to as a probe antenna or an exciter. FIG. 1A illustrates an example of a cavity-backed slot antenna that uses a "T-bar" 110 to excite a cavity-backed slot 120. (For brevity, a cavity-backed slot may be referred to in various contexts herein simply as a "slot" with equivalent meaning.) FIG. 1B illustrates an example of a cavity-backed slot antenna for which a single center coupling element 130 feeds the cavity-backed slot 120. Both of these conventional designs typically exhibit drawbacks, e.g. a narrow operating bandwidth.

Some conventional antennas are advertised to be able to perform across the UHF television broadcast band, e.g. from 470 MHz to 700 MHz, but such capability is typically limited by the requirement to select in advance an operating channel to which the antenna is tuned and acceptable performance can be expected. Outside the selected operating channel, the antenna may exhibit an unacceptably high VSWR (voltage standing-wave ratio). Hence, if an antenna user were to select a different UHF channel, the antenna would either need to be re-tuned (if possible) or possibly even likely replaced. Furthermore, if the antenna were intended to serve several channels in the UHF-band, this is not easily achievable and will therefore likely result in very limited performance.

SUMMARY

The inventors disclose various apparatus and methods that may be beneficially applied to, e.g., radio frequency transmission and/or reception. While such embodiments may be expected to provide improvements in performance and/or reduction of cost or size relative to existing antennas, no particular result is a requirement of the present invention unless explicitly recited in a particular claim.

One embodiment provides an apparatus, e.g. an antenna. The antenna includes first and second coupling plates, or RF excitation structures, and a conducting bar, e.g. stripline signal feed. This assembly may be referred to as a "coupling device". The first coupling plate is connected at a first end of the conducting bar and the second coupling plate is connected at a second end of the conducting bar, thus forming an excitation structure that may be located in a cavity-backed slot. A signal feed connected to the conducting bar may provide a radio-frequency (RF) signal to the coupling plates to provide UHF or VHF transmission capability with relatively flat gain. The conducting bar may optionally have about a 50Ω characteristic impedance.

In some embodiments opposing major surfaces of each of the coupling plates have a rectangular profile, and may further have an aspect ratio of about two. In one example, each of the coupling plates has a short axis dimension of about 60 mm and a long axis dimension of about 120 mm. In some other embodiments the first and second coupling plates have a teardrop profile, with a surface area of each major surface being about 70 $cm^2$.

In some embodiments the conducting bar and first and second coupling plates are formed as a unitary structure, while in some other embodiments the conducting bar and the plates are formed separately and joined with fasteners. The unitary structure, which may optionally be metallic, may be formed from an aluminum alloy sheet, e.g. having a thickness of about 3 mm. In other embodiments the unitary structure may be formed by coating a nonconductive base material, e.g. plastic, with a conductive layer.

Some embodiments of the antenna include a cavity-backed slot to which at least one of the first and second coupling plates is attached. Some embodiments include first and second coupling devices, wherein the coupling devices are nominally identical. The first and second coupling devices are both attached to the cavity-backed slot and are spaced apart by at least a length of one of the coupling devices. In some embodiments a conducting wall, e.g. a ground plane, is located within the cavity-backed slot and about equally spaced between the first and second coupling devices.

Other embodiments provide methods of manufacturing an antenna component, e.g. according to any of the embodiments described above.

BRIEF DESCRIPTION OF THE DRAWINGS

A more complete understanding of the present invention may be obtained by reference to the following detailed description when taken in conjunction with the accompanying drawings wherein.

DETAILED DESCRIPTION

Figure 1B:
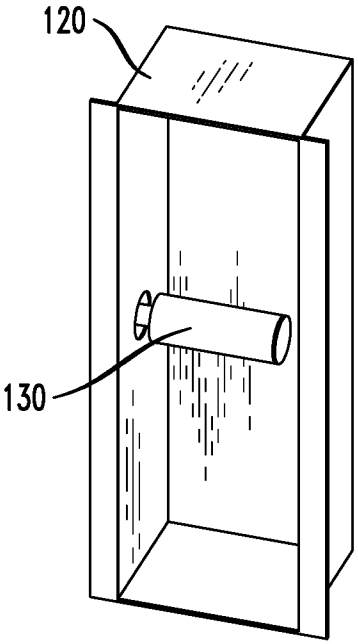
FIG. 1B PRIOR ART
FIGS. 1A and 1B illustrate conventional cavity-backed slot antennas, wherein the antenna of FIG. 1A is fed via a T-bar, and the antenna of FIG. 1B is fed via a single coupling element.
Figure 1A:
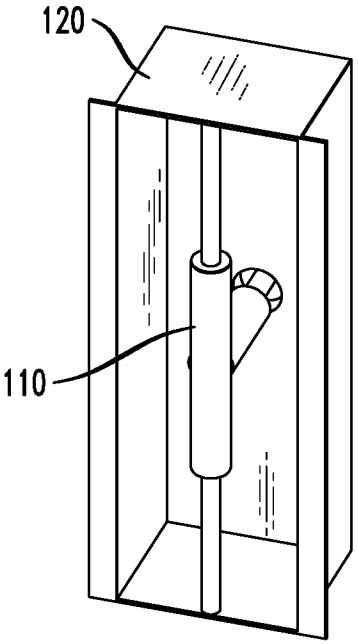
FIG. 1A PRIOR ART

Various embodiments are now described with reference to the drawings, wherein like reference numerals are used to refer to like elements throughout. While such embodiments may be expected to provide improvements in performance and/or reduction of cost relative to conventional approaches, no particular result is a requirement of the present invention unless explicitly recited in a particular claim. In the following description, for purposes of explanation, numerous specific details are set forth in order to provide a thorough understanding of one or more embodiments. It may be evident, however, that such embodiment(s) may be practiced without these specific details. In other instances, well-known structures and devices are shown in block diagram form in order to facilitate describing one or more embodiments.

It is desirable that a cavity-backed slot antenna be able to perform across a frequency band of interest with relatively flat azimuthal gain over a wide angle. For example, for the case of UHF (ultra-high frequency) transmission, it may be desirable to transmit with relatively flat azimuthal gain in a band from about 470 MHz to about 700 MHz. In this context "relatively flat" means that the gain varies by no more than about 3 dB (±1.5 dB) over the frequency range of interest, e.g. about 470 MHz to about 700 MHz. A similarly wide range may be desired in the context of some VHF (very high frequency) applications as well. However, as previously described, known conventional cavity-backed slot antenna designs are unable to provide such broadband performance. For instance, the use of a single coupler is thought to limit the degrees of freedom available to the antenna designer, and may cause the slot to have a narrow useable bandwidth.

To address deficiencies of such conventional antennas, various embodiments described herein provide an antenna radiator element that includes an excitation structure with multiple couplers, referred to generally as a "coupling device", that includes two coupling plates in a single cavity that are fed by a stripline power divider. The coupling device provides a suitable operating bandwidth, is physically stable, is electrically and thermally conductive, and also easy to manufacture at low cost. Some embodiments, for example, may be formed from easily machined and inexpensive sheet metal. Furthermore, some embodiments are able to meet a very high power rating requirement, e.g. >2 kW per bay, such as by avoiding E-field concentration at various antenna components.

Antennas configured according to the principles described herein advantageously provide a coupling device that does not significantly adversely affect the horizontal or vertical radiation pattern of the cavity-backed slot antenna. Moreover, the coupling device may be easily fabricated in a single unitary structure that includes a terminal to receive an RF signal. In various embodiments the coupling device only significantly excites the horizontally polarized radiation components and substantially suppresses the vertically polarized radiation components, leading to some of the aforementioned advantageous performance attributes.

Figure 2D:
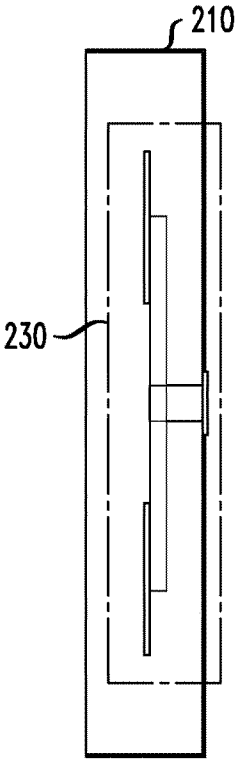
FIGS. 2A-2D illustrate various views of an antenna component according to various described embodiments, e.g. a cavity-backed slot antenna, including a cavity-backed slot and a coupling device having "teardrop"-shaped coupling plates.
Figure 2C:
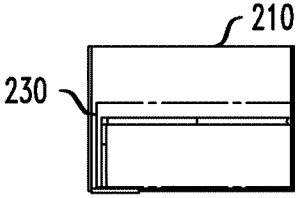
Figure 2B:
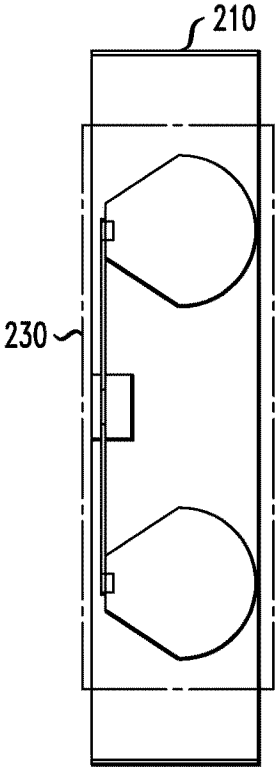
Figure 2A:
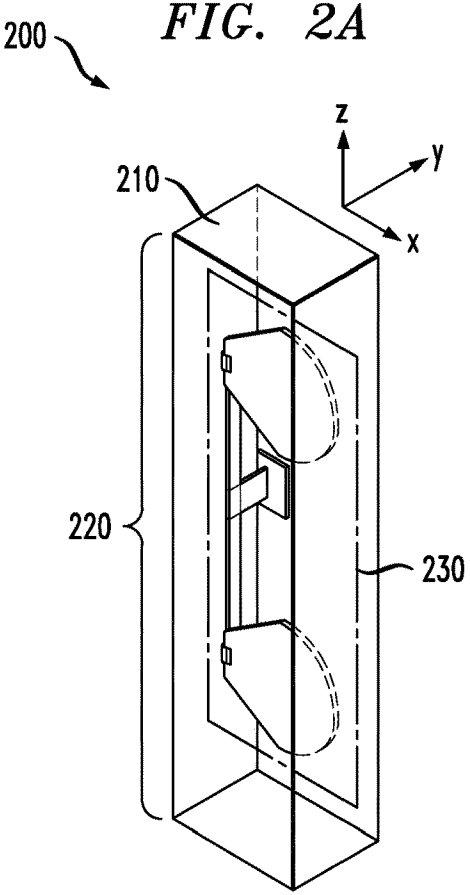

Turning now to FIGS. 2A-2D, various views are presented of an embodiment, e.g. an antenna 200, consistent with the principles of the disclosure. FIG. 2A displays an isometric view along with reference xyz coordinate axes. FIG. 2B displays a view along the y-axis, FIG. 2C displays a view along the z-axis, and FIG. 2D displays a view along the x-axis. A cavity-backed slot 210 includes an opening 220, e.g. a slot. A coupling device 230 is located within the cavity-backed slot 210.

Figure 3B:
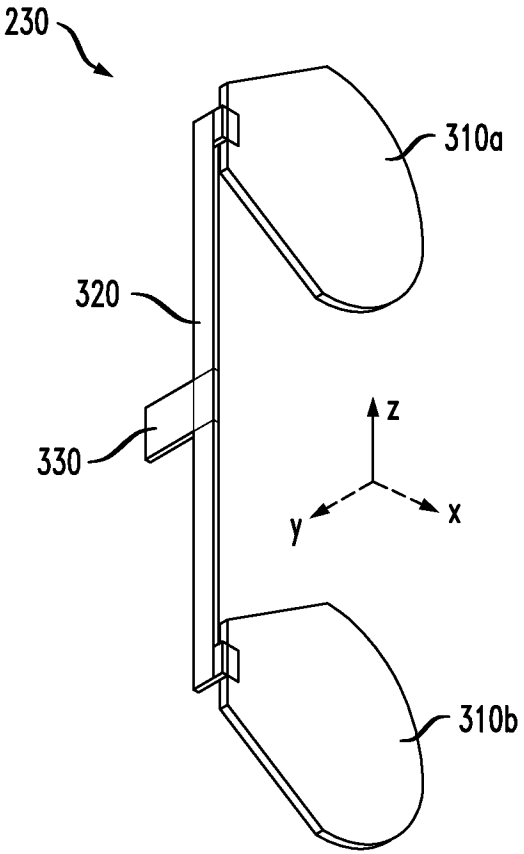
FIGS. 3A-3E illustrate various views of the coupling device of FIGS. 2A-2D, including the conducting bar, and first and second coupling plates connected at opposite ends of the conducting bar.
Figure 3A:
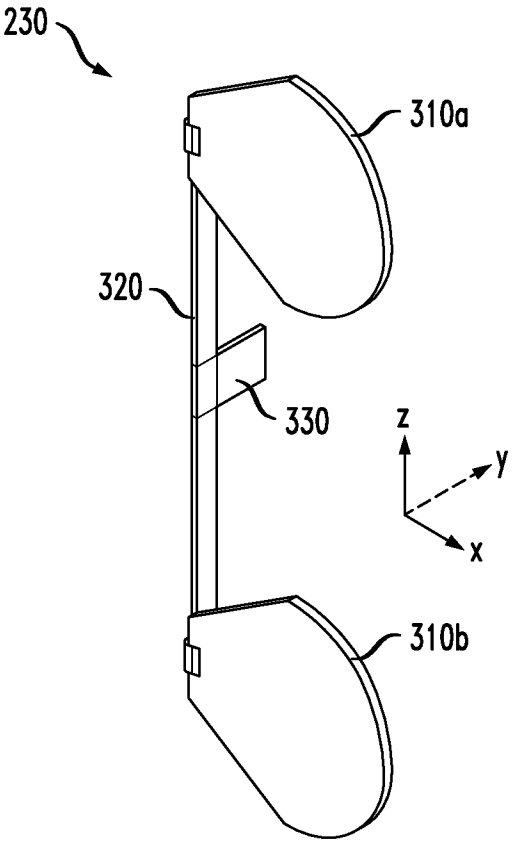
Figure 3E:
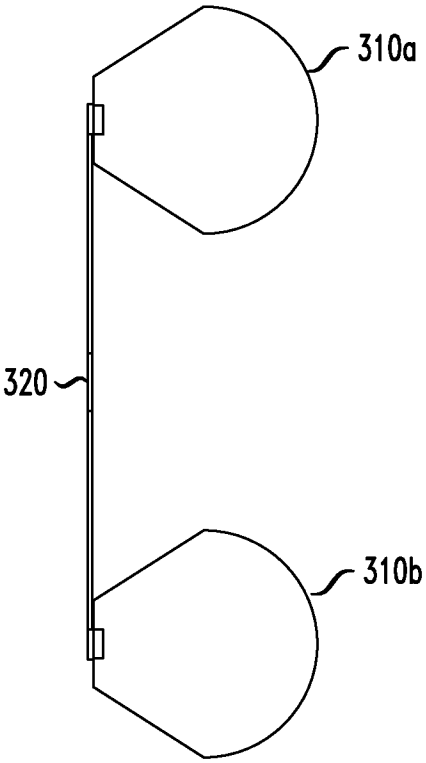
Figure 3D:
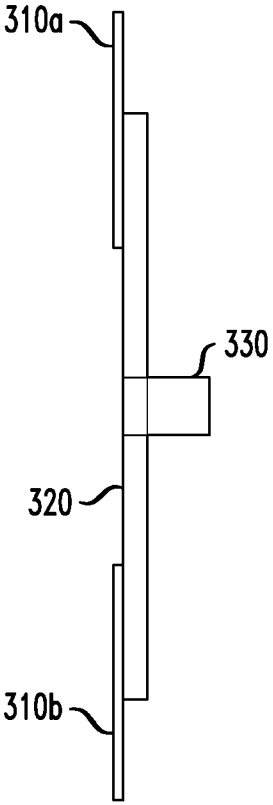
Figure 3C:
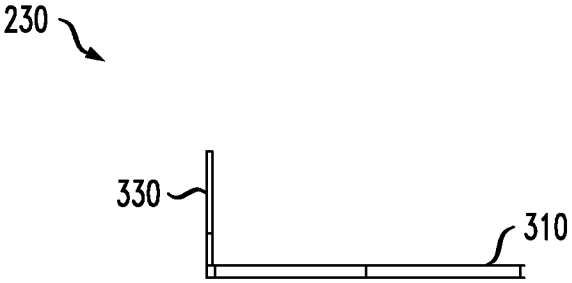

FIGS. 3A-3E show the coupling device 230 in several views to make more apparent various details thereof. FIGS. 3A and 3B provide different isometric views with accompanying reference xyz coordinate axes. FIGS. 3C, 3D and 3E respectively illustrate the coupling device 230 as viewed in the xy, yz and xz planes. Referring concurrently to FIGS. 3A-3E, the coupling device 230 includes two coupling plates 310*a* and 310*b* connected by a conducting bar 320. In view of this arrangement, the coupling device 230 may be viewed as a "second-order element", as it has two separate couplers and thereby possesses greater inherent wideband properties than provided by a typical first order excitation. An antenna feed 330 acts to feed an RF signal to the conducting bar 320. The conducting bar 320 in turn mechanically supports the coupling plates 310*a* and 310*b* and distributes the RF power to them.

The coupling plates 310*a*, 310*b* each have first and second opposing major surfaces that may each be about symmetrical about an axis of symmetry that is about normal to the conducting bar 320. The area of the major surfaces may be tens of square centimeters, and will in general be determined, e.g. by electromagnetic modeling, according to the particular intended frequency band of operation intended. The major surfaces of the coupling plates 310*a*, 310*b* may be coplanar, and the axes of symmetry of the coupling plates 310*a*, 310*b* may be about parallel.

While the coupling plates 310 are shown as having approximately a "teardrop" profile, they are not limited to such. Thus, for example, the coupling plates 310 may in various embodiments have a profile that is circular, square, rectangular, elliptical or triangular in the xz plane as viewed in FIGS. 3A, 3B and 3E. In another aspect the coupling plates 310 are plate-like. By plate-like, it is meant that the coupling plates 310 have one dimension (e.g. "thickness") that is relatively small compared to dimensions in two other mutually orthogonal directions. Referring to the coupling plates 310*a*, 310*b* as one non-limiting example, these plates are relatively thin in the y-direction compared to the extent in the x-direction and the z-direction. By "relatively thin", it is meant that the thickness is no greater than about 10% of the smallest extent in the other, orthogonal directions. In some cases, is may be preferred that the plate thickness be no greater than about 5% of the smallest of the other, orthogonal directions.

The conducting bar 320 may be configured as a stripline conductor. Those skilled in the pertinent art will appreciate that a stripline is a conductive path that, in relation to a ground plane, provides a characteristic impedance $Z_o$, e.g. 50Ω in some embodiments. Those skilled in the art are capable of selecting dimensions of the conducting bar to obtain a desired characteristic impedance.

Referring to FIGS. 2A-2D, with continued reference to FIGS. 3A-3E, the coupling device 230 has a symmetrical second-order coupling arrangement. The coupling device 230 is configured to provide, e.g. when energized with RF power in the UHF or VHF band, mutual coupling between the coupling plates 310*a* and 310*b* thereby exciting the cavity-backed slot 210. This manner of excitation is believed to significantly enhance the useable bandwidth of the slot. For example, and without implied limitation, embodiments consistent with the disclosure are expected to have a VSWR of less than 1.1:1 in the frequency range of about 470 MHz to about 700 MHz when configured for UHF operation. Furthermore, the excitation by the two coupling plates 310*a*, 310*b* provides a multitude of degrees of freedom, thereby allowing full customization of the coupling device 230 components depending on the operational requirements of the antenna 200. For example, beamwidth, frequency range and mutual coupling can be optimized by selection of appropriate values of one or more of major surface area, aspect ratio and shape. In general, the design parameters of the coupling plates 310 may be determined for a particular implementation by modeling.

The coupling device 230 and its components are not limited to any particular mechanical dimensions, which may be determined by one skilled in the pertinent art depending on, e.g., an intended operating frequency. By way of example, for UHF transmission the coupling plates 310 may be about 50-150 mm in length and width, e.g. as shown the x and z directions of FIGS. 3A and 3B. The coupling plates 310 may be separated by between about 50 mm and about 200 mm, for an overall length of between about 150 mm and about 500 mm.

Figure 4C:
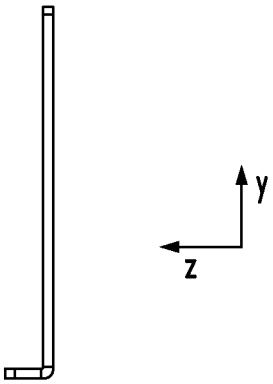
FIGS. 4A-4C illustrate a coupling device including rectangular coupling plates and a stripline feed formed as a single unitary structure.
Figure 4A:
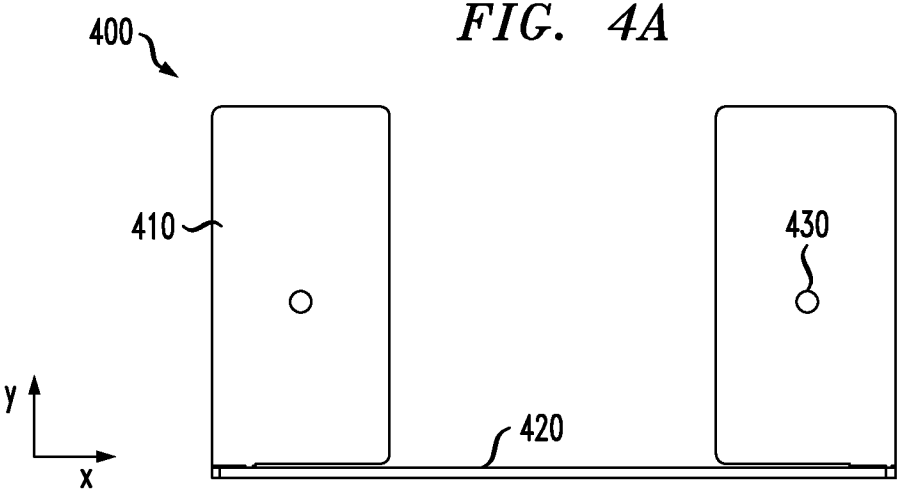
Figure 4B:
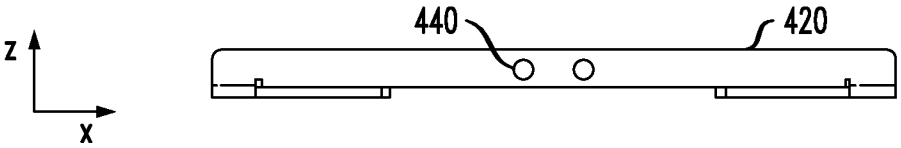

In another example, FIGS. 4A-C and 5A-5C present an embodiment of an antenna assembly that may be suitable for relatively flat azimuthal gain over a wide range of the UHF or VHF bands. FIGS. 4A-C provide a detail views of a coupling device 400 in each of three mutually orthogonal viewing directions, and referred to concurrently. Coupling plates 410*a*, 410*b* have an approximately rectangular profile, with first and second opposing major surfaces and a thin edge surface. By rectangular, it is meant that the major surfaces of the coupling plates 410*a*, 410*b* have a long axis (e.g. length) that is at least about 5% larger than a short axis (e.g. width). In the present non-limiting example, the coupling plates 410*a*, 410*b* have a long axis dimension of about 120 mm and a short axis dimension of about 60 mm, an area of about 72 $cm^2$. Thus the coupling plates 410*a*, 410*b* have an aspect ratio of about two, though of course embodiments are not limited to such. In this specific example embodiment, the dimensions may be particularly suited to use in UHF applications. More generally, the area of the coupling plates 410*a*, 410*b* (as well as the coupling plates 310*a*, 310*b*) may be determined by the desired frequency of operation of the antenna of which the plates are a part. For example, an antenna intended for VHF operation (e.g. about 30 MHz-300 MHz) may have a larger area than an antenna intended for UHF operation (e.g. about 300 MHz-3 GHz). Thus it is to be understood that specific dimensions provided for various embodiments are non-limiting, and other embodiments within the scope of the disclosure may have other dimensions and areas as determined in part by the specific intended frequency of operation.

The coupling plates 410*a*, 410*b* are connected by a stripline feed 420 (e.g. a conducting bar) and are separated by about 110 mm such that the coupling device 400 has an overall length of about 230 mm. The coupling plates 410*a*, 410*b* are oriented such that the short axis is oriented parallel to the stripline feed 420, though embodiments are contemplated in which the major direction is instead oriented parallel to the stripline feed 420, or in which the plates coupling plates are square. The stripline feed 420 has a width of about 15.5 mm and a thickness of about 3 mm, and includes holes 440 to connect a signal source. Thus in this embodiment the stripline feed 420 provides a characteristic impedance of about 50Ω. Those skilled in the pertinent art will recognize that 50Ω is a commonly-used value for characteristic impedance, but suitable adjustments may be made to the stripline feed 420 to yield a different characteristic impedance as appropriate for a particular implementation.

Advantageously, the coupling plates 410 and stripline feed 420 may be, and in the illustrated embodiment are, formed from a single piece of sheet metal, e.g. aluminum alloy, providing for inexpensive fabrication and simple tooling and yielding a unitary metallic structure. "Unitary" in this context means that the coupling plates 410 and stripline feed 420 are formed from a single, continuous sheet material without mechanical interruption or interfaces, and therefore without the need for fasteners to attach the coupling plates 410 to the stripline feed 420. In one example, the coupling plates 410 and the stripline feed 420 may be formed from a flat metallic sheet by cutting, stamping or sawing, after which the stripline feed 420 may be bent 90° with respect to the coupling plates 410. Of course, embodiments are also contemplated in which the coupling plates 410 and stripline feed 420 are formed separately and joined by any suitable fasteners or welding.

In some embodiments the coupling plates and/or the stripline feed 420 may be formed from a nonconductive base material, e.g. fiberglass or plastic, and coated with a conductive layer such as by spray or electroplate. In some embodiments such a base layer may be formed by steps including, e.g. molding, cutting, gluing, solvent welding, and/or additive manufacturing (sometimes referred to as 3-D printing).

The coupling plates 410*a*, 410*b* each include a hole 430 which may be used to connect the coupling device 400 to a cavity-backed slot via an insulating spacer rod, formed from a material that has a small dielectric loss tangent at RF frequencies, e.g. a ceramic or a plastic such as nylon or PTFE (poly-tetrafluoro-ethylene, Teflon®). (See, e.g., FIG. 5C.)

Figure 5A:
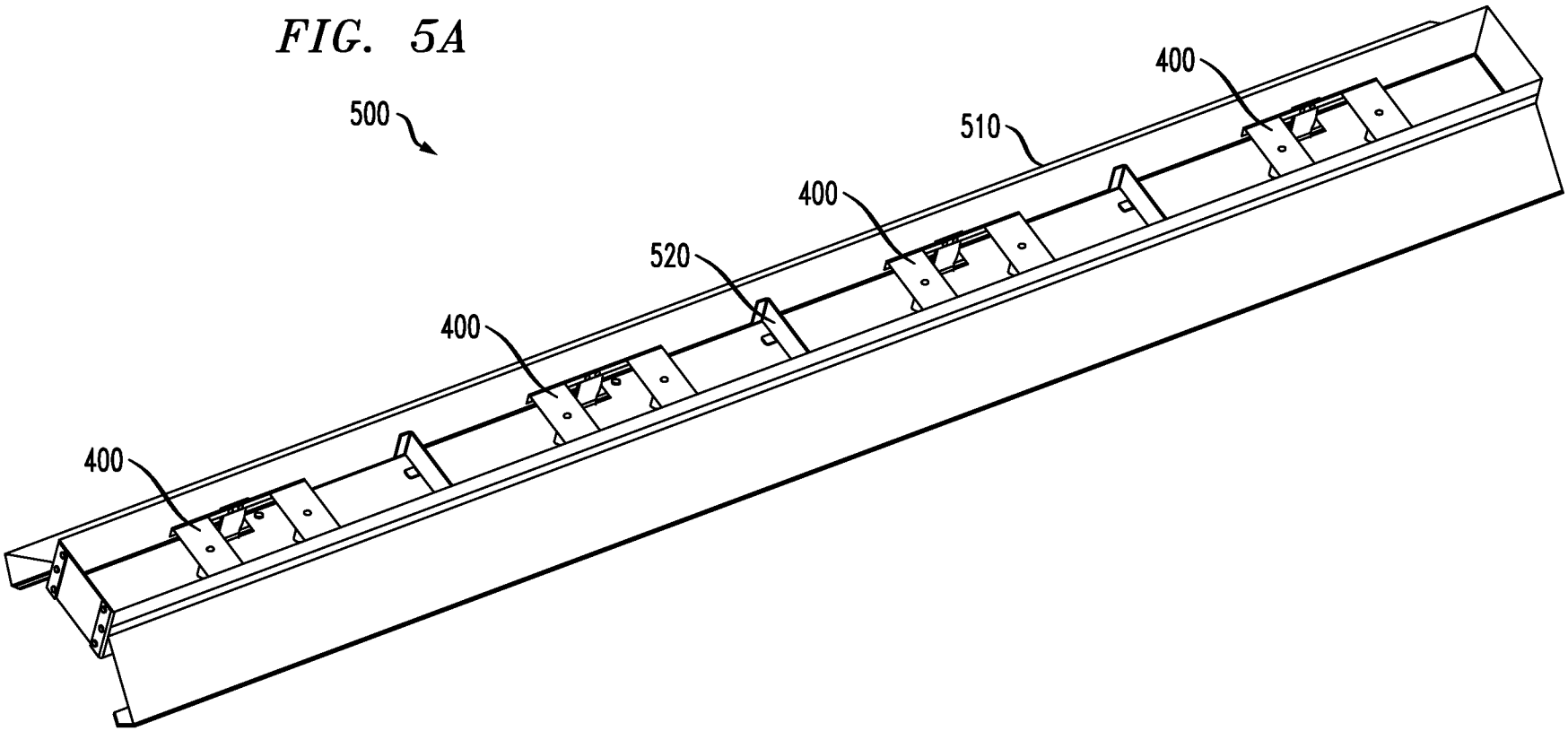
FIGS. 5A-5C illustrate aspects of an antenna array assembly that includes multiple instances of a coupling device such as described in FIGS. 4A-4C.
Figure 5B:
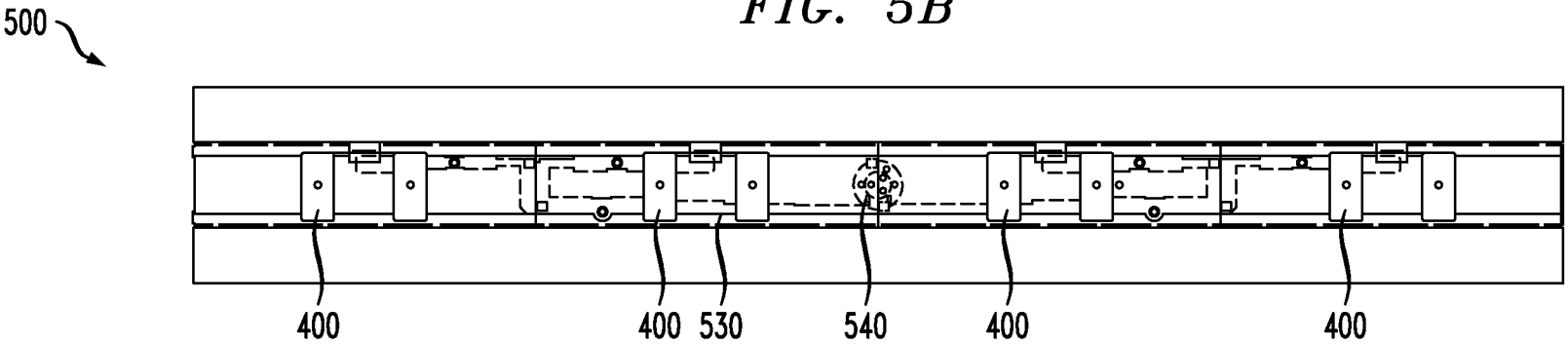
Figure 5C:
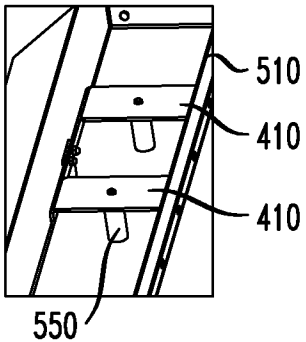

FIGS. 5A-5C illustrate various views of an antenna array 500, e.g. a cavity-backed slot broadband antenna. FIG. 5A shows a cavity-backed slot 510 and four instances of the coupling device 400. Typically, the antenna array 500 includes a radome, which is omitted in this figure for illustration purposes. The coupling devices 400 are spaced from each other along the long axis of the cavity-backed slot 510 with an optional wall 520, e.g. a ground plane, located at about a midpoint between adjacent coupling devices 400. The wall 520 may operate to divide the slot 510 into multiple cavity-backed slots. In some embodiments the coupling devices 400 are spaced apart by a distance that is at least as large as an overall length of the coupling devices 400. In this specific and non-limiting example the distance between adjacent coupling devices is about twice the overall length of the coupling devices 400. With suitable selection of relevant dimensions of the coupling devices 400, the illustrated configuration may support transmission and reception of signals in, e.g. a UHF band from about 470 MHz to about 700 MHz, or a VHF band from about 170 MHz to about 235 MHz, with relatively flat azimuthal gain, as previously described.

It is expected that an antenna array configured consistent with described embodiments are capable of providing an azimuthal gain with variation no greater than ±1.5 dB over an azimuthal angle range up to about 180°. However, those skilled in the pertinent art will appreciate that the realized gain of such embodiments may depend in part on external parasitic structures, e.g. antenna tower components and/or ground planes placed to intentionally limit azimuthal angle range.

FIG. 5B shows a top view of the antenna array 500 drawn such that the cavity-backed slot 510 is transparent, revealing feed striplines 530 behind the cavity-backed slot 510 that distribute RF power from a signal source input port 540 to each of the coupling devices 400. In various embodiments it may be preferable to deliver about a same signal power to each of the coupling devices 400. It is within the capability of those skilled in the pertinent art to determine a suitable power distribution layout to achieve a desired power distribution among the coupling devices 400. The FIG. 5C shows a detail view of one of the coupling devices 400, including insulating posts 550 as described earlier used to attach the coupling plates 410 to the cavity-backed slot.

Although multiple embodiments of the present invention have been illustrated in the accompanying Drawings and described in the foregoing Detailed Description, it should be understood that the present invention is not limited to the disclosed embodiments, but is capable of numerous rearrangements, modifications and substitutions without departing from the invention as set forth and defined by the following claims.

Unless explicitly stated otherwise, each numerical value and range should be interpreted as being approximate as if the word "about" or "approximately" preceded the value of the value or range.

It will be further understood that various changes in the details, materials, and arrangements of the parts which have been described and illustrated in order to explain the nature of this invention may be made by those skilled in the art without departing from the scope of the invention as expressed in the following claims.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they formally fall within the scope of the claims.

The description and drawings merely illustrate the principles of the invention. It will thus be appreciated that those of ordinary skill in the art will be able to devise various arrangements that, although not explicitly described or shown herein, embody the principles of the invention and are included within its spirit and scope. Furthermore, all examples recited herein are principally intended expressly to be only for illustrative purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

The invention claimed is:

1. An antenna, comprising:

a conducting bar;

a first coupler plate connected at a first end of said conducting bar and a second coupler plate connected at a second end of said conducting bar;

a slot cavity to which at least one of said first and second coupler plates is attached; and an antenna feed connected to said conducting bar;

wherein said first and second coupler plates and said conducting bar form a first emitter, and further comprising a second emitter that is nominally a duplicate of said first emitter, wherein said first and second emitters are both attached to said slot cavity and spaced apart by a distance that is at least as large as an overall length of said emitters.

2. The antenna as recited in claim 1, wherein said first and second coupler plates have a rectangular profile.

3. The antenna as recited in claim 2, wherein said coupler plates have a long axis dimension of about 120 mm and a short axis dimension of about 60 mm.

4. The antenna as recited in claim 1, wherein said first and second coupler plates have a teardrop profile.

5. The antenna as recited in claim 1, wherein said conducting bar and first and second coupler plates are formed as a unitary metallic structure.

6. The antenna as recited in claim 5, wherein said unitary metallic structure is formed from an aluminum alloy sheet.

7. The antenna as recited in claim 1, further comprising a conducting wall located within said slot cavity and about equally spaced between said first and second emitters.

8. The antenna as recited in claim 1, further comprising a feed stripline located within said slot cavity and configured to distribute radio-frequency (RF) power from a signal source to both said first and second emitters.

9. A method of manufacturing an antenna component, comprising:

forming a conducting bar;

forming a first coupler plate connected at a first end of a conducting bar and a second coupler plate connected at a second end of said conducting bar; and attaching at least one of said first and second coupler plates within a slot cavity;

wherein said first and second coupler plates and said conducting bar form a first emitter, and further comprising attaching within said slot cavity a second emitter that is nominally a duplicate of said first emitter, wherein said first and second emitters are spaced apart by at least a length of said emitters.

10. The method as recited in claim 9, wherein said first and second coupler plates have a rectangular profile.

11. The method as recited in claim 10, wherein said coupler plates have a long axis dimension of about 120 mm and a short axis dimension of about 60 mm.

12. The method as recited in claim 9, wherein said first and second coupler plates have a teardrop profile.

13. The method as recited in claim 9, wherein said conducting bar and first and second coupler plates are formed as a unitary metallic structure.

14. The method as recited in claim 13, wherein said unitary metallic structure is formed from an aluminum alloy sheet.

15. The method as recited in claim 9, further comprising locating a conducting wall within said slot cavity and about equally spaced between said first and second emitters.

16. The method as recited in claim 9, further comprising connecting both said first and second emitters to a feed stripline located within said slot cavity and configured to distribute radio-frequency (RF) power from a signal source to both said first and second emitters.

17. An antenna, comprising:

a conducting bar;

a first coupler plate connected at a first end of said conducting bar and a second coupler plate connected at a second end of said conducting bar;

a slot cavity to which at least one of said first and second coupler plates is attached; and an antenna feed connected to said conducting bar;

wherein excitation of the first coupler plate and the second coupler plate excites surfaces defining the slot cavity.

* * * * *